US009221658B2

(12) United States Patent
Matti

(10) Patent No.: US 9,221,658 B2
(45) Date of Patent: Dec. 29, 2015

(54) DEVICE FOR PICKING UP LOADS

(75) Inventor: Rob Matti, Valkenburg (NL)

(73) Assignee: GRIPTECH B.V., Heusden (NL)

( * ) Notice: Subject to any disclaimer, the term of this patent is extended or adjusted under 35 U.S.C. 154(b) by 423 days.

(21) Appl. No.: 13/812,841

(22) PCT Filed: Jul. 25, 2011

(86) PCT No.: PCT/EP2011/062723

§ 371 (c)(1),
(2), (4) Date: Apr. 8, 2013

(87) PCT Pub. No.: WO2012/013625

PCT Pub. Date: Feb. 2, 2012

(65) Prior Publication Data

US 2013/0189064 A1 Jul. 25, 2013

(30) Foreign Application Priority Data

Jul. 29, 2010 (DE) ..... 10 2010 038 663

(51) Int. Cl.
*B66F 9/14* (2006.01)

(52) U.S. Cl.
CPC .. *B66F 9/14* (2013.01); *B66F 9/144* (2013.01)

(58) Field of Classification Search
CPC ..... B66F 9/14; B66F 9/142; B66F 9/143; B66F 9/144
See application file for complete search history.

(56) References Cited

U.S. PATENT DOCUMENTS 2,270,664 A 1/1942 Weaver
2,663,443 A * 12/1953 Schenkelberger ..... 414/667
2,788,148 A * 4/1957 Parcell ..... 414/621
3,424,328 A 1/1969 Gideonsen et al.
3,987,913 A * 10/1976 Lickfold ..... 414/544
4,630,855 A 12/1986 Bjurling
5,096,363 A * 3/1992 Weinert et al. ..... 414/667
5,338,148 A 8/1994 Ronnblom

FOREIGN PATENT DOCUMENTS

DE 1008656 11/1955
DE 3632031 A1 4/1988
DE 19528885 C1 10/1996
DE 10347003 A1 5/2005

(Continued)

OTHER PUBLICATIONS

PCT, International Preliminary Report on Patentability, dated Jan. 29, 2013 (English).

(Continued)

*Primary Examiner* — Jonathan Snelting

(74) *Attorney, Agent, or Firm* — International IP Law Group, PLLC

(57) ABSTRACT

Embodiments of the subject innovation relate to a device for picking up loads, having a frame, two load pick-up elements that are configured so as to move lengthwise on the frame, two drive units that are installed on the frame and arranged one above the other, whereby each drive unit has a drive element and is configured to move this drive element relative to the frame in two opposite directions parallel to the direction of motion of the load pick-up elements, whereby force-transmissions and deflectors are provided on the drive elements. By activating the drive units, a movement of the drive elements can be converted into a corresponding movement of the appertaining load pick-up elements.

15 Claims, 7 Drawing Sheets

(56) References Cited

FOREIGN PATENT DOCUMENTS

| | | | |
|---|---|---|---|
| DE | 202010002764.0 | U1 | 7/2010 |
| EP | 0774441 | A3 | 9/1998 |
| GB | 750793 | | 6/1956 |
| JP | 06001598 | A | 1/1994 |

OTHER PUBLICATIONS

German Patent Application 10 2010 038 663.4, German Patent Office Office Action, dated Jul. 22, 2011 (German).
International Search Report, dated Dec. 28, 2011 (English) and German.

* cited by examiner

DEVICE FOR PICKING UP LOADS

CROSS REFERENCE TO RELATED APPLICATION

Pursuant to 35 U.S.C. §371, this application is the United States National Stage Application of International Patent Application No. PCT/EP2011/062723, filed on Jul. 25, 2011, the contents of which are incorporated by reference as if set forth in their entirety herein, which claims priority to German Patent Application No. DE 10 2010 038 663.4, filed Jul. 29, 2010, the contents of which are incorporated by reference as if set forth in their entirety herein.

BACKGROUND

Devices for picking up loads can be integrated, for example, into a forklift or can be configured as an add-on accessory that is or can be attached to a piece of equipment such as, for instance, a forklift. These devices usually have two load pick-up elements that can be moved relative to each other and that can be in the shape, for example, of two fork tines that can be moved relative to each other. The mobility of the fork tines allows users to adjust the position of the fork tines to the width of an object that is to be picked up or to recesses in said objects into which the fork tines can be inserted. With the known approaches, this is done, for example, with rail systems and hydraulic drives, as a result of which the fork tines can be moved to the left and to the right and, at the same time, can be moved toward each other or away from each other, so that there are two maximum positions for the load pick-up elements. In one maximum position, the two fork tines are arranged in the middle, whereas in the other maximum position, each of the two fork tines is in an outermost position and the two fork tines are at a maximum distance from each other. Examples of known approaches are described in U.S. Pat. No. 3,424,328 and in British patent GB 750,793.

The known approaches described above are suited for transporting loads that have been placed onto conventional pallets such as, for example, Euro pallets, whereby the known load pick-up devices are adapted to the dimensions of these pallets. In certain applications, however, the transport of loads using the prior-art approaches is hardly or not at all possible, when the load to be transported is not, for example, on a Euro pallet but rather on a relatively narrow base or on a surface with a small footprint and is thus narrower than the frame or the width of the forklift. If such a load is, for instance, in a truck, container or warehouse very close to a wall or to another object, then it cannot be picked up and transported away by conventional load pick-up systems, or else cannot be put down at the desired position near another object to begin with, since the movement of the forklift is hindered by the side wall and, with the prior-art approaches, the fork tines cannot be moved so far to the side. In such application cases, it might only be possible to move a single outer fork tine underneath the load base in order to pick up the load and to subsequently transport it away using only this single fork tine. However, transporting loads away with a single fork tine is associated with balance problems that could cause the forklift to tip over or the load to fall off the fork tine, so that, also for safety reasons, it is generally not permissible or envisaged to transport loads away using a single fork tine.

German Preliminary Published Application No. DE 36 32 031 A1 discloses an attachment for a forklift with which the fork tines are suspended on a fork carrier plate and, in the unloaded state, they can be moved sideways by hydraulic cylinders, independently of each other. Thus, with the device disclosed there, it is also possible to move both fork tines, for example, to one side of the fork carrier plate so that narrow loads that are, for example, on a pallet directly against a wall such as a container wall can be picked up with a forklift. However, the fork tines cannot be moved past the cylinder housing that drives them and they cannot be positioned in front of the cylinder housing that drives them, as a result of which it is only possible to a limited extent to move an individual fork tine over to the other half of the fork carrier on which the other fork tine is located. Moreover, since the fork tines of this device can only be moved when they are not carrying a load, after a load that is arranged in this way has been picked up, it also has to be transported in the same, asymmetrical position. This can lead to stability problems. The document proposes overcoming this problem by installing the device for individually moving the fork tines onto a known side-movement device. Such side-movement device can move both fork tines together, even under load. The distance of the fork tines relative to each other cannot be changed with such a device. If both functions, namely, the independent sideways movement of the two fork tines relative to each other and the joint sideways movement of both fork tines under load, are to be realized, then the two devices have to be combined with each other. However, if both of these devices have to be installed on the forklift, their additional intrinsic weight diminishes the load-bearing capacity of the forklift. Moreover, the space requirement of the forklift itself is increased, leading, for instance, to problems in maneuvering in tight spaces in warehouses. Furthermore, the two devices are expensive. Another drawback of this approach is the fact that conventional forklifts only provide two hydraulic connections in the form of two pairs of hydraulic lines at the attachment site of the load pick-up element, whereas three separate hydraulic connections are used for the combination of the two devices.

SUMMARY

Claimed embodiments relate to a device for picking up loads, whereby said device is or can be attached to another piece of equipment.

A device for picking up loads makes it is possible to use two load pickup elements to safely and easily pick up extremely narrow loads as well as wider loads, to adjust the loads sideways, to put them down and to transport loads that cannot be transported with known devices due to the dimensions of the loads and the spatial situation in the vicinity of the loads. Moreover, the device may be attached or attachable to another piece of equipment such as, for example, a forklift. In this context, it may be possible to use the device to pick up and put down even narrow loads so far to the side that the forklift is still maneuverable relative to a truck wall or container wall or other objects. The device may be compact and built with a small construction depth so that the forklift loses as little load-bearing capacity as possible. Moreover, it may be possible for a load that has been picked up at the side to be moved into a middle position of the fork tines relative to the forklift in order to permit safe transport of the load.

Two drive units are arranged one above the other and installed on the frame, whereby each drive unit has a drive element and is configured to move said drive elements relative to the frame independently of each other, simultaneously, or consecutively in two opposite directions, or else in the corresponding direction parallel to a direction of motion in a straight line, whereby it is also possible for only one drive element to be moved, while the other one stands still, whereby a first load pick-up element and a second load pick-up element on the frame are configured so as to move along this direction of motion. The load pick-up elements here can be configured, for example, in the form of a fork tine. However, the load pick-up elements can also be configured in the form of hooks, rods, gripping elements, etc. or else combinations thereof.

At least a first pair of deflectors is rigidly installed on the drive element of the first drive unit, and at least a second pair of deflectors is rigidly installed on the drive element of the second drive unit. The two deflection elements of each pair are at a distance from each other in the direction of motion. For each pair of deflection elements, there is a force-transmission that has a first attachment section and a second attachment section. Each force-transmission of the first pair and of the second pair is attached by the first attachment section to a prescribed area of the frame. Each force-transmission of the first pair is also attached by the second attachment section to the first load pick-up element, and each force-transmission of the second pair is attached by the second attachment section to the second load pick-up element. Moreover, each deflector is engaged with the force-transmission between the first attachment section and the second attachment section.

Here, it can also be provided that the two force-transmissions are made up of a closed force-transmission that is attached by two attachment sections to the frame and to a load pick-up element, so that, between the attachment points, actually two finite force-transmission sections are formed. Therefore, the term two force-transmission as put forward is also understood to mean two force-transmission sections of one single force-transmission.

The configuration of the device described above for picking up loads, whereby said device is or can be attached to a piece of equipment, makes it possible that a movement of the drive element of the first drive unit brought about by activating the first drive unit can be converted—via the deflectors of the first pair and via the force-transmission provided for the first pair—into a corresponding movement of the first load pick-up element along the direction of motion in a straight line, and that a movement of the drive element of the second drive unit brought about by activating the second drive unit can be converted—via the deflectors of the second pair and via the force-transmission provided for the second pair—into a corresponding movement of the second load pick-up element along the direction of motion in a straight line.

Since each of the drive elements can be moved relative to the frame in two opposite directions that are parallel to the direction of motion in a straight line, it is possible to move one of the two load pick-up elements independently of the other load pick-up element in one of the two directions that are opposite from each other. Thus, for example, after an appropriate activation of the first drive unit, the drive element of this drive unit can be moved from the right-hand side of the device to the left-hand side of the device, which is associated with a movement of the first load pick-up element from the right-hand side to the left-hand side of the device. During this movement, the second load pick-up element can rest or, after the appropriate activation of the second drive unit, it can move in the same direction or else in the opposite direction. Here, it is especially possible to adjust the fork tines to such an extent that the outer edge of an outer first fork tine is flush with the outer edge of the frame or even extends beyond it, while the other, second fork tine can be moved to a position next to this first fork tine, so that the two fork tines abut each other. The fork tines can each be moved past the cylindrical housing that drives them and can also position them in front of the cylindrical housing that drives them, whereby this positioning can also take place under load. In particular, the fork tines can also be moved by the device in parallel, that is to say, in the same direction. Since this can also be done under load, even after the load has been picked up with both fork tines, they can be moved toward one side of the frame or else, after the load has been picked up asymmetrically relative to the frame; it can be moved to the middle without a separate device for this purpose.

Thanks to the uncoupling of the movement of the two load pick-up elements, unlike with the known approaches, it is also possible to safely and conveniently transport loads that cannot be transported with the prior-art devices due to the dimensions of the loads and the spatial situation in the vicinity of the loads. If a narrow load is situated, for example, very close to the wall of the warehouse or truck, it could not be picked up with a conventional system on a forklift since the side of the forklift would bump into the wall and the load pick-up elements would not permit any position in which it could be maneuvered to reach for the load that is to be picked up.

However, due to the uncoupling of the load pick-up elements, it is possible to move both load pick-up elements to one side of the device so that they are arranged, for instance, adjacent to each other or adjoining each other at an outer position (that is to say, for example, on the left-hand side) of the device, and both of them can be used in a corresponding movement in order to pick up or transport the load. If a narrow load is very close to the wall of a warehouse or truck, both load pick-up elements can be moved in this direction all the way to the outside in order to pick up the load there. In this process, the load pick-up elements can be moved into positions in which the outer edge of the outer load pick-up element is at least flush with the outer edge of the frame or even extends beyond it. The same applies to the other outer position on the right-hand side or to any in-between positions. The device is configured in such a way that loads picked up in these outermost positions can then be moved to the middle of the device and thus of a forklift so that the forklift can subsequently be moved together with the load. This is useful in order to prevent balance or stability problems, and the drive and guidance system of the device is configured so that it can not only freely move the load pick-up elements but also so that that it can safely move picked-up loads horizontally. At least two guide rails for the load pick-up elements are provided on the frame so that a picked-up load can be moved by the device sideways relative to the frame. In this process, the first load pick-up element can be configured so as to move in the first rail, and the second load pick-up element can be configured so as to move in a second rail installed on the frame, whereby the longitudinal axis of the first rail and the longitudinal axis of the second rail run parallel to each other. The guide rails can be configured as sliding guides or roller guides, and they permit the load pick-up elements to be moved sideways smoothly, jolt-free, and parallel, even when they are carrying the maximum permissible load for that particular device. By providing the two rails, in order to improve the mechanical stability and to increase the load-bearing capacity of the device, a suspension mount for the load pick-up elements that is situated in the rails can be configured to be wider than the load pick-up element itself, and this can actually be done without having to accept that it will no longer be possible to move the two load pick-up elements completely against each other or to bring them into contact with each other as would only be the case with a shared rail. Consequently, by providing two guide rails, it is possible that, in spite of suspension mounts that can be wider than the load pick-up elements, the two load pick-up elements can be moved to be close to each other. Due to the combination of these guide rails with the drive of the sideways traversing movement of the load pick-up elements by supple force-transmissions that run over deflectors, it is possible to use a forklift to safely pick up very small loads as well as heavy loads that are stored in a position, for example, directly against a wall, and to subsequently also transport them safely. For this purpose, the fork tines can be moved into such an outer position that the outer fork tine is flush with the outer edge of the frame to which it is attached, or even extends beyond it, while the second fork tine is in direct contact with the inside of the outer fork tine so that, after this load has been picked up, said fork tine can be moved sideways with the load to a middle area of the frame in order to ensure a safe transport in the lengthwise direction of the forklift.

Thus, for example, in an opposite movement, the two load pick-up elements can be adapted in advance to the width of the load that is to be picked up and positioned, and subsequently, the picked-up load can be moved in a corresponding movement all the way to the outside of the frame. Hence, loads having a width that is up to ¼ of the frame width can be placed by the forklift against a truck or container wall.

Another advantage of the two drive units is that the force required to move the load pick-up elements, including the weight of the load, in a corresponding movement is generated by the two drive units, as a result of which each drive unit can be configured smaller. The attachment can thus be designed much more compactly, with a smaller overall depth and less weight.

The fact that the movement of the drive elements is converted—via the deflectors of the first or second pair of and via the force-transmission provided for the first or second pair—into a corresponding movement of the first or second load pick-up element has the advantage that the maximum distance by which the load pick-up elements can be moved in a straight line can be designed to be substantially greater. The maximum distance of approaches that exclusively use drive units with drive elements that can be moved in a straight line is limited, especially as a result of the prescribed extension of the drive elements in the direction of movement. Since the movement is converted via the deflectors of the first or second pair of deflectors and via the force-transmission provided for the first or second pair of deflectors, the maximum distance by which the load pick-up elements can be moved in a straight line can be can be increased, under the boundary condition of a prescribed maximum lengthwise extension or maximum crosswise extension of the device.

In one embodiment, the drive units are formed by a piston drive with cylinder housing and two piston rods that are attached to the frame, whereby the cylinder housing forms the drive element. Here, the piston rods are connected inside the cylinder housing to a piston that extends over the inner cross section of the cylinder housing, thus separating two areas inside the cylinder housing from each other. Due to the feed of hydraulic medium into these two areas and due to the discharge of hydraulic medium out of these two areas inside the cylinder housing, the cylinder housing can then be moved along the piston rods in two opposite directions. If hydraulic medium such as oil is fed into one of the areas, this area fills with hydraulic oil while hydraulic oil is discharged from the other area, to that the cylinder housing moves.

In order for both areas inside a cylinder housing to be separate from each other and so that no direct exchange of hydraulic medium can occur between the areas, there is a gasket between the piston and the inner surface of the cylinder housing.

For one thing, a drive unit thus configured permits a controlled movement. Moreover, it can be designed to be low-maintenance and sturdy so that it can be used for a prolonged period of time without extensive maintenance work.

In one embodiment, the deflectors are installed directly on the associated cylinder housing. As a result, the area where the deflectors are installed can also be used for the movement of the cylinder housing. Furthermore, as a result, the end pieces of the cylinder housing can be kept short, thereby optimizing the stroke length.

In another embodiment, the drive units can be hydraulically connected to each other via a hydraulic control unit, whereby the areas inside the first cylinder housing that are separate from each other can be connected to the areas inside the second cylinder housing that are separate from each other in such a way that a volume of hydraulic medium that is discharged from an area inside the first cylinder housing can, at the same time, be fed into an area inside the second cylinder housing. Thus, it is possible to connect two drive units in series and to convert the movement of one cylinder housing directly into a movement of the other cylinder housing.

The movements of the drive element that are in corresponding directions or in opposite directions, however, can also be generated by using a separate hydraulic control unit or by using distributor valves.

In one embodiment, each piston rod has an interior channel whose one end is in communication with a feed site and with a discharge site for hydraulic medium, and whose other end has an opening leading towards one of the separate areas inside the cylinder housing. With this approach, the connections for the hydraulic medium can each be arranged at the fixed end of the piston rod, and no connections to the moving cylinder housing are used.

Instead of a hydraulic piston drive, however, other drives with which a drive element can be moved in two opposite directions can also be employed. For example, electric drives, worm gears, etc. can be used.

In one embodiment, in one drive unit, the device has two first pairs of deflectors and two second pairs of deflectors, each provided with force-transmissions, whereby the deflectors of one pair of the two first pairs are arranged above the deflectors of the other pair of the two first pairs in such a way that, in each case, an axis of symmetry of a deflector of the one pair is flush with an axis of symmetry of a deflector of the other pair, and whereby the deflectors of one pair of the two second pairs are arranged above the deflectors of the other pair of the two second pairs in such a way that, in each case, an axis of symmetry of a deflector of the one pair is flush with an axis of symmetry of a deflector of the other pair. If a deflector is configured in such a way that it can rotate around itself, this axis of symmetry is the axis of rotation.

Consequently, two pairs of deflectors and four associated force-transmissions can be arranged above and below one drive unit. Accordingly, torsion of the drive units when the load pick-up elements move can be avoided and an even movement of the load pick-up elements can be achieved, namely, in that, for each drive unit and thus also for the movement of each load pick-up element, two pairs of deflectors, each provided with force-transmissions, are provided whose axes of symmetry are flush. Thus, a force is exerted on the drive element at the same time above and below the drive element when a load pick-up element is to be moved.

In one embodiment, the first load pick-up element is configured so as to move in a first rail installed on the frame, and the second load pick-up element is configured so as to move in a second rail installed on the frame, whereby the longitudinal axis of the first rail and the longitudinal axis of the second rail run parallel to each other.

In another embodiment, the first load pick-up element and the second load pick-up element are additionally configured so as to move in a third shared rail, whereby here, the first and second rails are arranged above the drive units, while the third rail is arranged below the drive units. This creates an effective and stable guidance of the load pick-up elements and this also permits the movement of very high loads relative to the frame. As an alternative, however, the guide frame thus formed can also consist of a simple upper and lower guide rail or of a double guide rail.

In another embodiment, a tensioner is provided on the first attachment section and/or on the second attachment section of each force-transmission. This tensioner can adjust or correct the tension of the force-transmission sections that is used for an effective conversion of the movement of the drive elements into the corresponding movement of the first load pick-up element or of the second load pick-up element, said force-transmission sections extending between the first and the second attachment sections. Advantageously, when the drive unit is a hydraulic drive unit that can lose hydraulic fluid in case of a leak, such a loss would be associated with a reduction in the tension of the force-transmission or with sagging of the force-transmission.

In another embodiment, the force-transmission tensioners are lined up with the associated force-transmission. As a result, the force introduced by the tensioners into the appertaining force-transmission is symmetrical.

In another embodiment, each force-transmission is attached via an attachment to a prescribed area of the frame on the one hand, and to a load pick-up element on the other hand, whereby at least one attachment is configured as a force-transmission tensioner, and whereby the two attachments of each force-transmission are arranged vertically offset with respect to each other, so that they can overlap. As a result, less installation length is needed and the sideways adjustment capability of the load pick-up elements is increased.

In another embodiment, the frame of the device has a lengthwise extension parallel to the direction of motion, and the prescribed area of the frame to which each force-transmission of the first pair and of the second pair of deflectors is attached by the first attachment section situated halfway along the length of the frame. In this manner, a symmetrical design can be achieved for the device, along with a distribution of the load during operation. The prescribed area of the frame to which each force-transmission of the first pair and of the second pair of deflectors is attached by the first attachment section formed by a vertical frame strut. The frame and the frame strut can be augmented by a continuous baseplate or can be formed by such a baseplate, but, in comparison to a heavy baseplate, the frame shape offers the advantage that it weighs less and it allows the user of the device to see through the device.

The attachment of the force-transmission to the frame, however, can also be provided so as to be offset further toward the outside. The force-transmissions overlap in the rear area over a greater length. Since there is no strut halfway along the length of the frame, the deflectors can travel past the middle of the frame.

In one embodiment, the piece of equipment to which the device for picking up loads is or can be attached is a forklift. The piece of equipment, however, can be any other piece of equipment such as, for example, a transport truck that is used in a warehousing system and that can run, for example, on rails.

The force-transmission can be any kind of flexible, supple media that can transmit tensile forces. Examples of conceivable options include chains or else belts such as, for example, toothed belts or V-belts, or else cables. Accordingly, the deflectors can be configured, for example, as rollers or fixed bolts. In this context, the term "rollers" is used to refer to all deflectors that are mounted on bearings so as to rotate around themselves such as pulleys, sprockets or else rollers with or without profiles along their circumference. Fixed bolts as deflectors are characterized in that they cannot rotate around themselves. They can have a circumferential surface with or without profiles. In this context, the force-transmission can be combined with any appropriate deflectors. For example, chains as force-transmissions can be combined not only with sprockets, but also with deflection rollers or pulleys as the deflectors.

BRIEF DESCRIPTION OF THE DRAWINGS

An embodiment will be explained in greater detail below with reference to the accompanying drawings. The following is shown:

FIGS. 6A to 6C show different positions of this load pick-up element;

Figure 1:
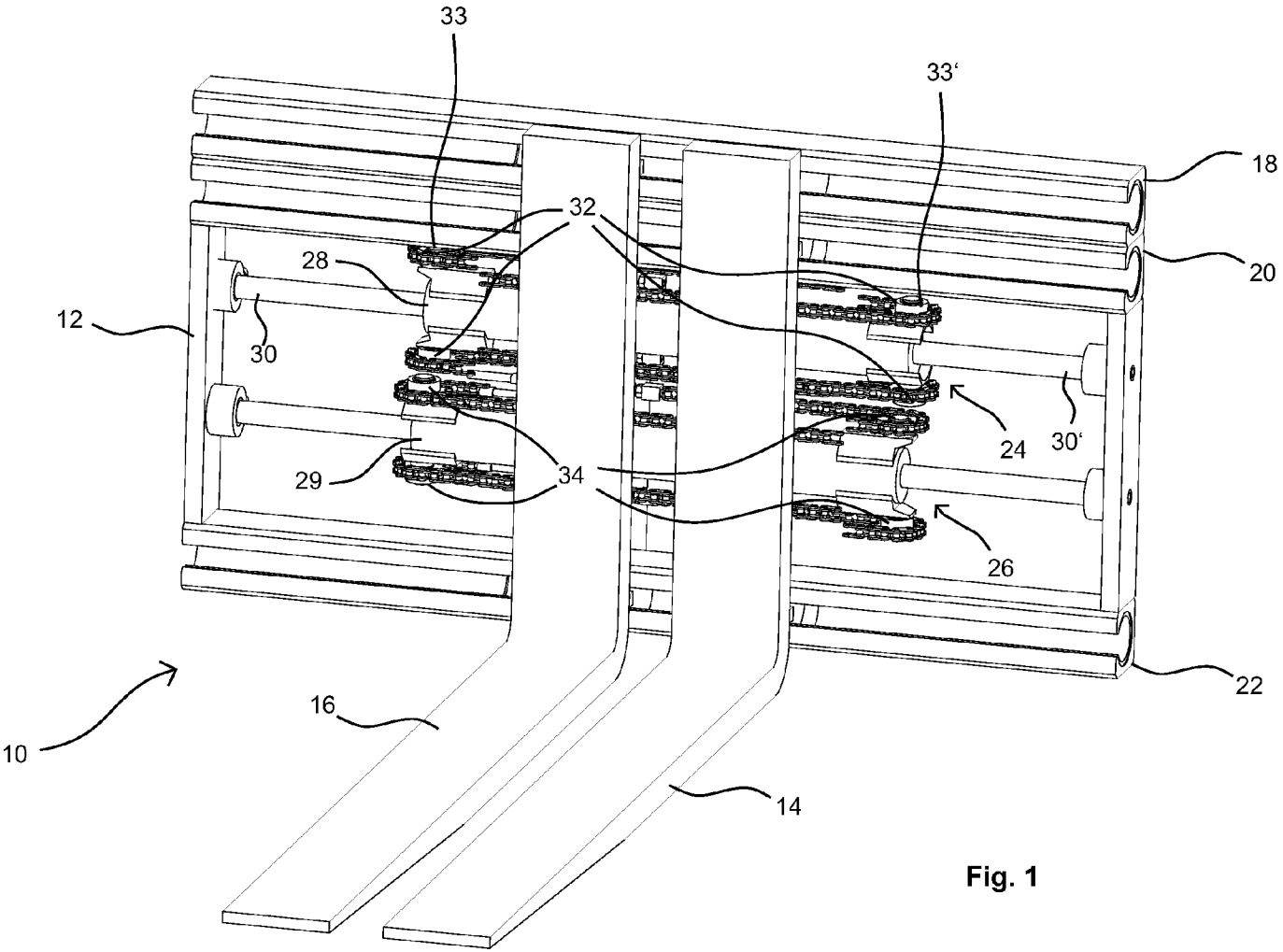
FIG. 1 is a three-dimensional depiction of an embodiment of a device according to the subject innovation for picking up loads, with both load pick-up elements in a middle position.

As can be seen in FIGS. 1 to 5, the device 10 for picking up loads—whereby said device 10 is already attached to a piece of equipment such as, for instance, a forklift, or else can be attached to it as an add-on accessory—comprises a frame 12 as well as a first load pick-up element 14 and a second load pick-up element 16 which are in the form of fork tines. These load pick-up elements are installed on the frame 12 so as to move along a rectilinear direction of motion, whereby the first load pick-up element 14 is configured so as to move in a first rail 18 installed on the frame 12, and the second load pick-up element 16 is configured so as to move in a second rail 20 installed on the frame 12. In this context, the longitudinal axis of the first rail 18 and the longitudinal axis of the second rail 20 run parallel to each other, these two rails being situated in the upper area of the device 10. In addition, the first load pick-up element 14 and the second load pick-up element 16 are configured so as to move in a third shared rail 22 located in the lower area of the device.

DETAILED DESCRIPTION OF SPECIFIC EMBODIMENTS

The device 10 shown also has a first drive unit 24 and a second drive unit 26 that are installed on the frame 12 and that are arranged one above the other, whereby each drive unit 24, 26 has a drive element 28, 29, and is configured to move the appertaining drive element relative 28, 29 relative to the frame 12 in two opposite directions parallel to the direction of motion. The two load pick-up elements 14, 16 are coupled via chain drives to the drive elements 28, 29 so that a movement of a drive element can be converted into a movement of the load pick-up element coupled thereto. Since each load pick-up element has its own drive unit, each load pick-up element can be actuated and moved individually. As an alternative, the two drive elements can also be connected in series, so that the actuation of the one drive element automatically brings about a movement of the second drive element, whereby, depending on the hydraulic configuration, either a movement in the opposite direction (setting of the fork tine distance) or in the same direction (parallel adjustment of the two fork tines) takes place.

Each drive unit 24, 26 is configured, for example, in the form of a piston drive having a cylinder housing 24, 26 and two piston rods that are installed on the frame 12, whereby the cylinder housing forms the drive element 28, 29. For the sake of simplifying the drawing, only two piston rods 30 and 30' are designated with reference numerals in the figures, whereby they are both upper piston rods of the upper drive unit 24.

Each piston drive has a connection (not shown here) to a feed site and to a discharge site for the hydraulic fluid as well as a control unit by which the associated cylinder housing can be moved to the left and to the right the along the piston rods 30, 30'. For this purpose, the piston rods 30, 30' are connected, for example, inside the cylinder housing, to a piston that extends over the inner cross section of the cylinder housing, thus separating two areas inside the cylinder housing from each other. Each cylinder housing can then be moved in two opposite directions along the piston rods 30, 30' by feeding a hydraulic medium into these two areas and discharging the hydraulic medium out of these two areas.

The drive units 24, 26 can be connected to each other hydraulically via the hydraulic control unit, whereby the areas separated from each other inside the first cylinder housing can be connected to the areas separated from each other inside the second cylinder housing in such a way that a volume of hydraulic medium that is being discharged from one area inside the first cylinder housing can be simultaneously conveyed into an area inside the secondary cylinder housing. If, for example, a certain volume of hydraulic medium is discharged from an area inside the upper cylinder housing, since the other area in the same cylinder housing is supposed to be filled in order to move the cylinder housing, for instance, to the right, this removed volume is fed via the hydraulic control unit directly into an area inside the lower cylinder housing. Depending on the hydraulic control, the lower cylinder housing then likewise moves to the right or to the left by the same distance.

Each piston rod 30, 30' has an interior channel whose one end is in communication with a feed site and with a discharge site for hydraulic medium, and whose other end has an opening leading towards one of the separate areas inside the cylinder housing. The feed and discharge sites for the hydraulic medium are then located in areas where the piston rods are attached to the frame.

Moreover, the device 10 shown has two first pairs 32 of sprockets and two second pairs 34 of sprockets, each provided with their own chains. Here, for the sake of simplifying the drawing, only the sprockets 33 and 33' as well as the associated chains 35 and 35' of the upper drive unit 24 are designated with reference numerals in the figures.

In the embodiment shown, each drive unit 24, 26 has two pairs of sprockets, whereby one pair of sprockets is installed at the top of the cylinder and the other pair of sprockets is installed at the bottom of the cylinder. The sprockets of one pair of the two first pairs 32 are arranged above the sprockets of the other pair of the two first pairs 32 in such a way that, in each case, a rotational axis of one sprocket of the one pair is flush with a rotational axis of one sprocket of the other pair, whereby the sprockets of one pair of the two second pairs 34 are arranged above the sprockets of the other pair of the two second pairs 34 in such a way that, in each case, a rotational axis of one sprocket of the one pair is flush with a rotational axis of one sprocket of the other pair.

Figure 2:
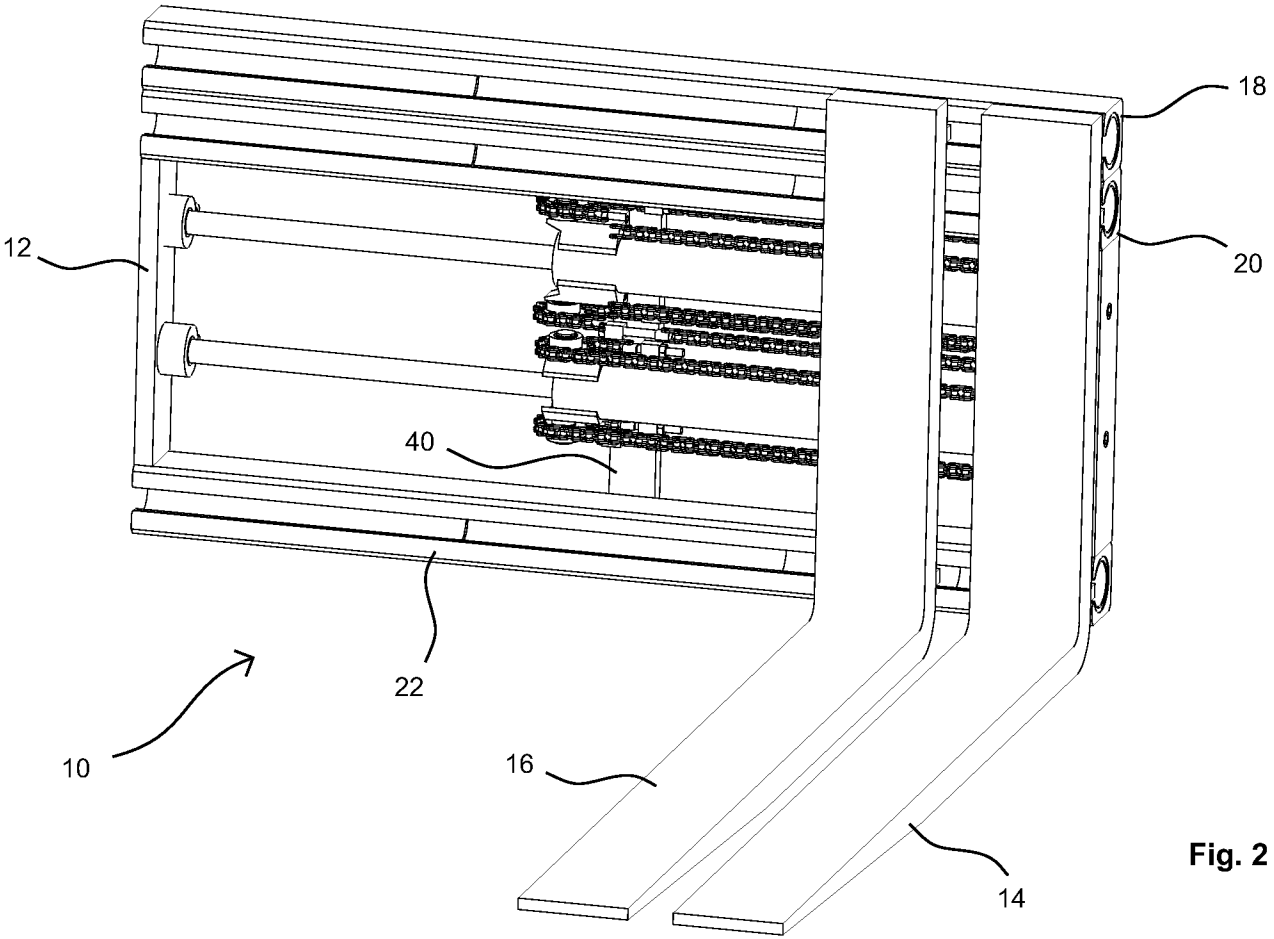
FIG. 2 is the embodiment of FIG. 1, with the two load pick-up elements in an outermost right-hand position.
Figure 3:
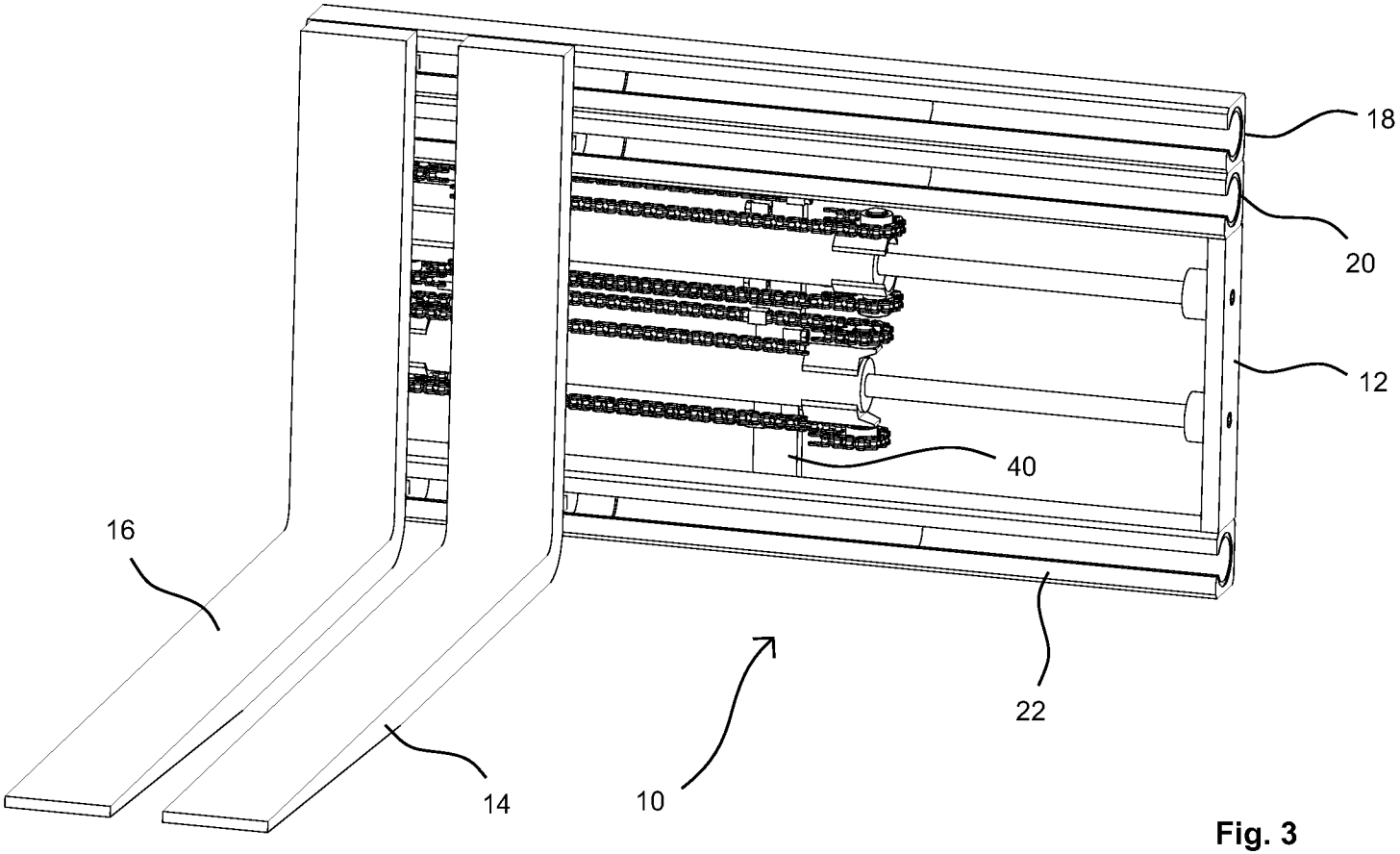
FIG. 3 is the embodiment of FIG. 1, with the two load pick-up elements in an outermost left-hand position.
Figure 4:
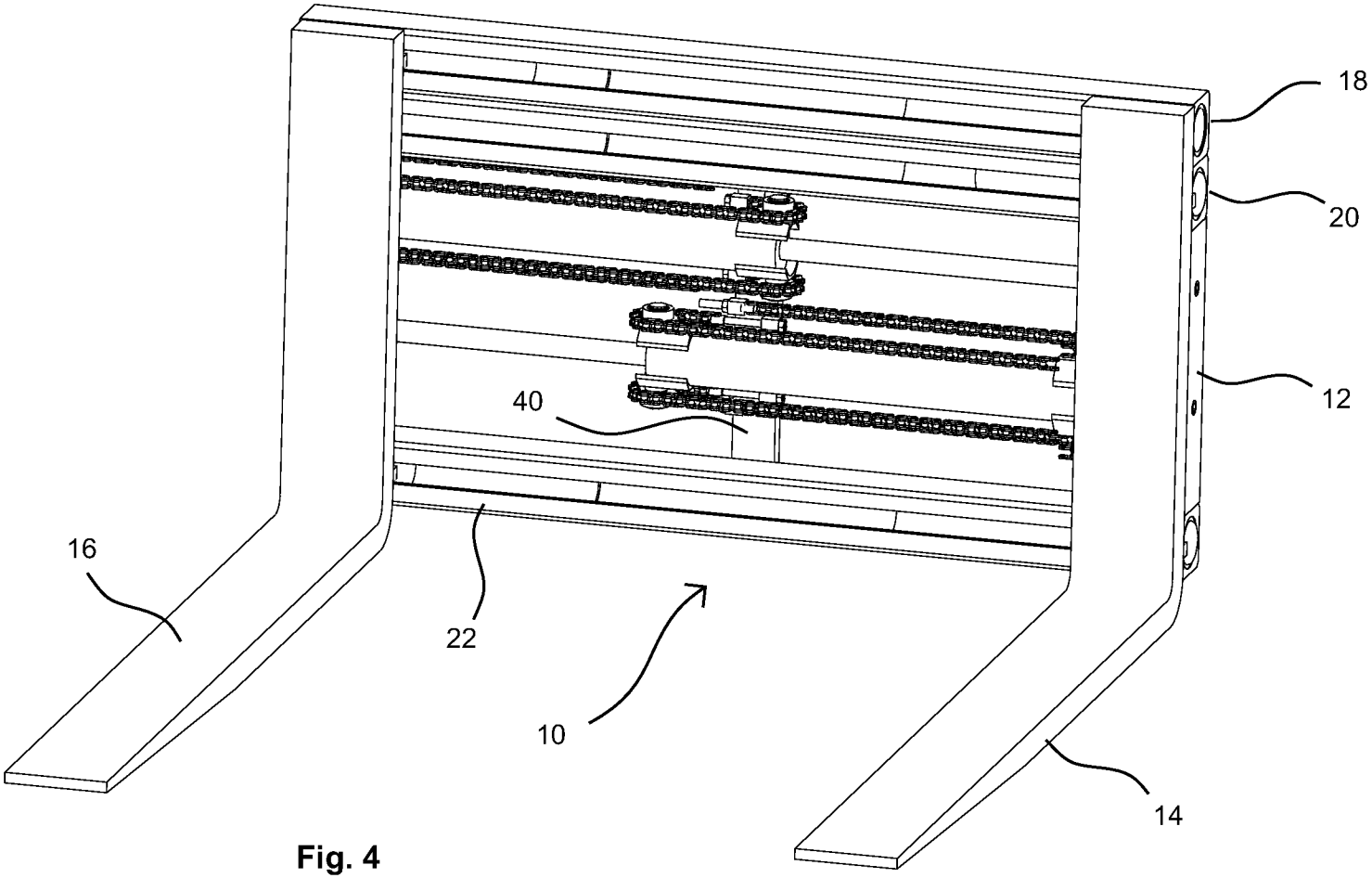
FIG. 4 is the embodiment of FIG. 1, with the two load pick-up elements in an outermost position.
Figure 5:
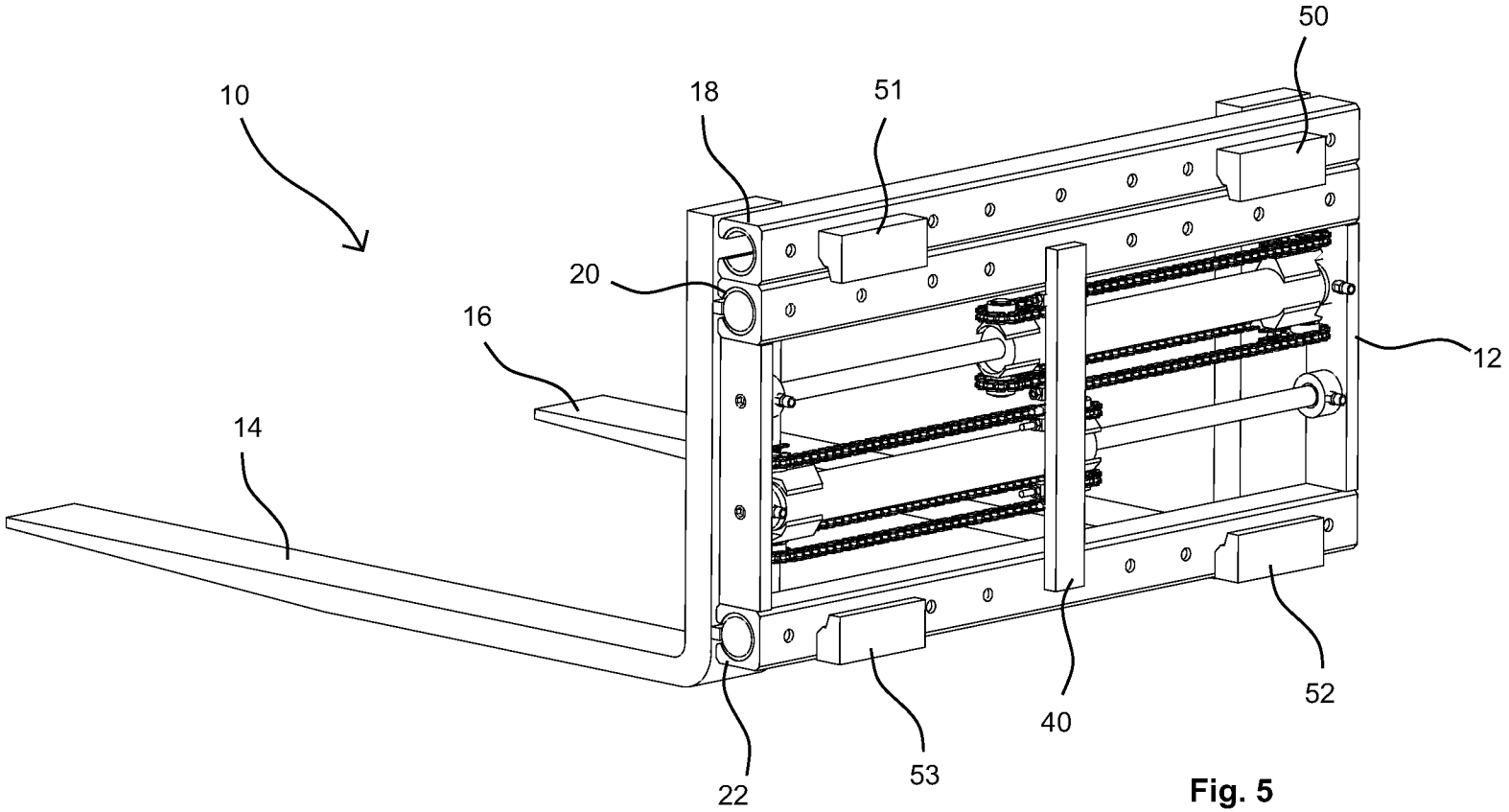
FIG. 5 is a rear view of the device, with the position of the load pick-up elements as shown in FIG. 4.

FIGS. 1 to 5 show the two load pick-up elements 14, 16 in different positions relative to the frame 12, whereby the situation of FIG. 1 is possible with conventional systems. FIGS. 2 and 3, however, show a situation in which both load pick-up elements 14, 16 are located outside on the right and left, respectively, which is not provided for in the prior-art approaches. FIG. 4, in contrast, shows a situation in which the two load pick-up elements are arranged at a maximum distance from each other, as is likewise possible with conventional systems. FIG. 5 shows this situation in a rear view, whereby the frame design of the device is illustrated. Here, a middle vertical frame strut 40 is provided on which the chains are installed by their attachment sections. Moreover, the frame can be provided with mounts 50, 51, 52, 53 with which the device can be mounted, for example, on a forklift.

Figure 6A:
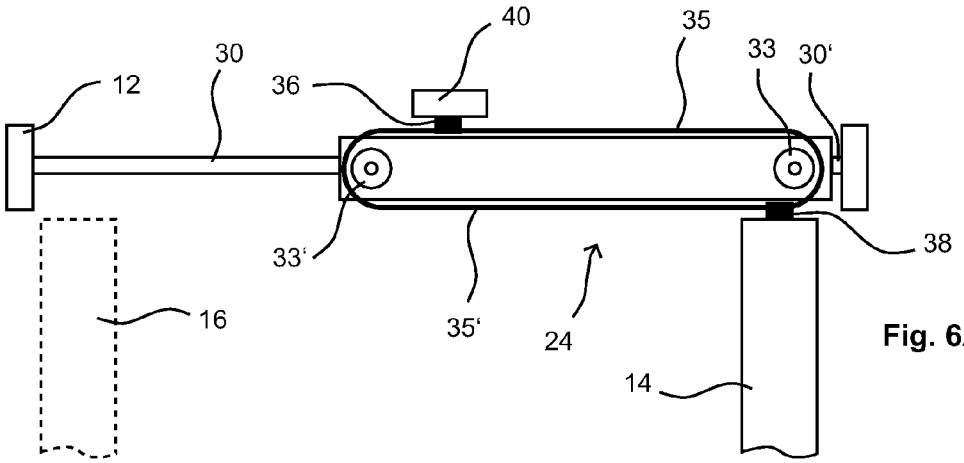
FIGS. 6A to 6C are individual schematic depictions of parts of a frame of the device in a top view together with schematic depictions of a drive unit, a pair of sprockets along with the associated chains, and a load pick-up element that can be moved by activating the schematically depicted drive unit, whereby
Figure 6B:
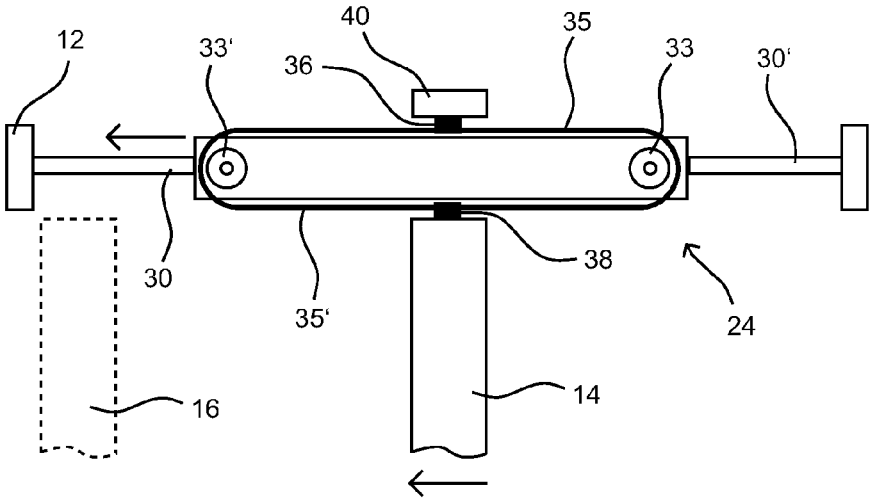
Figure 6C:
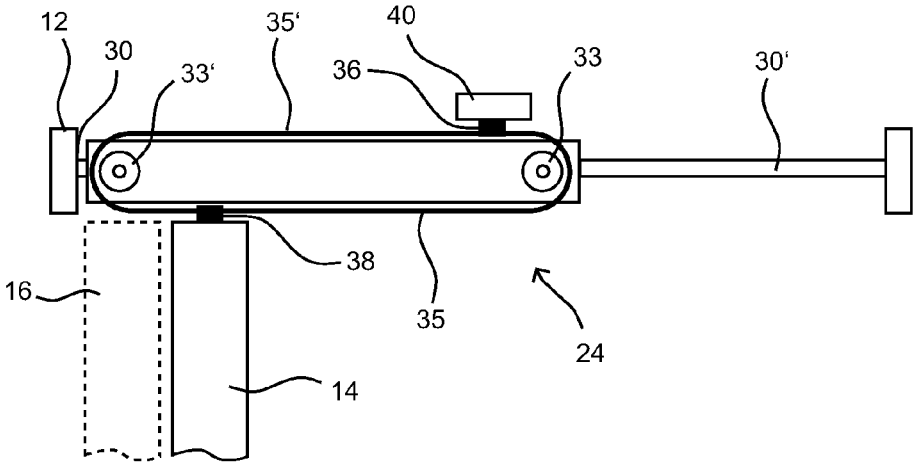

FIGS. 6A to 6C serve to illustrate the conversion of a linear movement of one drive element 28 of the device 10 into a corresponding movement of the load pick-up element 14. Here, only the upper drive unit 24 with the cylinder 28 that serves to move the right-hand fork tine 14 is schematically shown. The fork tine 16 that can be moved by the other drive unit 26 is merely indicated by a broken line in order to illustrate the position of the two fork tines with respect to each other.

FIGS. 6A to 6C each schematically show side parts of the frame 12 and of the rear frame strut 40 of the device 10, together with schematic depictions of a drive unit 24, a sprocket pair 32 consisting of two sprockets 33, 33' along with their associated chains 35, 35', whereby the sprocket pair 32 is rigidly attached to the drive element 28 of the drive unit 24. The drive element 28 runs on two piston rods 30 that are installed on the frame 12. The load pick-up element 14, which can be moved by activating the schematically depicted drive unit 24, is shown in FIGS. 6A to 6C in various positions.

A pair of sprockets 33, 33' is rigidly attached to the drive element 28, said sprockets being at a distance from each other in the direction of motion along which the load pick-up element 14 can be moved on the frame 12. For each sprocket, there is one chain with two ends, said chain having a first attachment section 36 in the form of a first end section, and a second attachment section 38 in the form of a second end section, whereby the first attachment section 36 of each chain is attached to a prescribed area of the frame 40 in the form of a vertical frame strut 40. Moreover, the second attachment section 38 of each chain is attached to the load pick-up element 14. Each one of the two sprockets is engaged with the chain between the first attachment section 36 and the second attachment section 38. Therefore, the first chain 35 runs from the attachment section 36 on the frame strut 40 to the attachment section 38 on the load pick-up element 14 via the sprocket 33 shown on the right-hand side in FIGS. 6A to 6C. The second chain 35', in turn, runs from the attachment section 36 to the attachment section 28 on the load pick-up element 14 via the sprocket 33' shown on the left-hand side in FIGS. 6A to 6C.

The two chains 35, 35' and the appertaining sprockets 33, 33', however, do not have to be in the same horizontal plane as schematically shown in FIGS. 6A to 6C, but rather, can be arranged vertically offset with respect to each other, as can be seen in the three-dimensional views of FIGS. 1 to 5.

Another pair of sprockets with the associated chains, which function identically, can also be attached at the bottom of the drive element 28.

When the upper drive unit 24 is activated in order to move the drive element 28, here from the right to the left, as indicated by the arrows in FIG. 6B, this movement brings about a corresponding movement of the load pick-up element 14, along with a clockwise rotation of the two sprockets 33, 33'. It can also be clearly seen in FIGS. 6A to 6C that, by the device, the maximum distance by which the load pick-up elements can be moved along a straight line can be structurally configured to be considerably greater than in the approaches which exclusively employ drive units with drive elements that are installed directly on the load pick-up elements in order to move the load pick-up elements. In this context, the right-hand load pick-up element 14, for example, is not moved all the way to the left-hand side, but rather, only as far as the other load pick-up element 14 that is positioned on this left-hand side.

The dimensions and the arrangements of the individual components are selected in such a manner that the path of a load pick-up element can be achieved. The length of a drive element 28 and the distance between the sprockets 33, 33', for instance, are selected in such a way that a sprocket 33, 33' is still situated beyond the middle frame strut 40 when the drive element 28 is almost striking the frame 12 at the side. The distance between the sprockets 33, 33' is selected accordingly.

Figure 7:
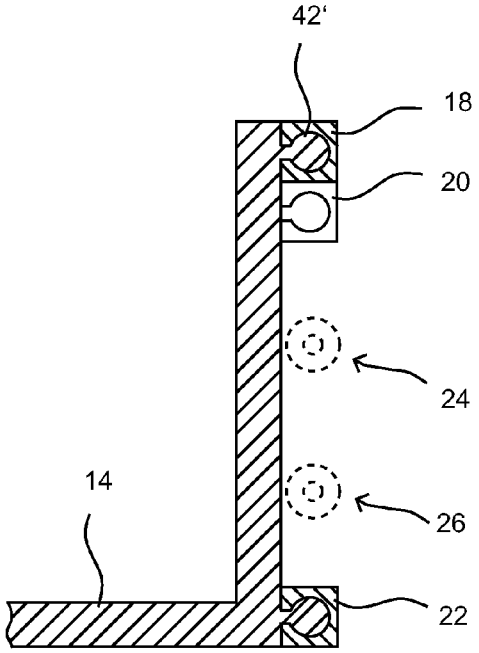
FIG. 7 is a schematic sectional view of a load pick-up element in three guide rails.

FIG. 7 is a schematic sectional view showing how the first load pick-up element 14 is configured so as to move in a first rail 18 installed on the frame 12, and showing how the second load pick-up element 16 is configured so as to move in a second rail 20 installed on the frame 12, whereby the two rails run above each other as well as parallel to each other. The load pick-up element 14 here is configured with a suspension mount 42' in the upper rail. It is likewise shown here how the first load pick-up element 14 and the second load pick-up element 16 are additionally configured so as to move in a third shared rail 22, whereby the first and second rails 18, 20 are arranged above the drive units 24, 26, indicated by a broken line, whereas the third rail 22 is arranged below the drive units 24, 26, indicated by a broken line.

Figure 8:
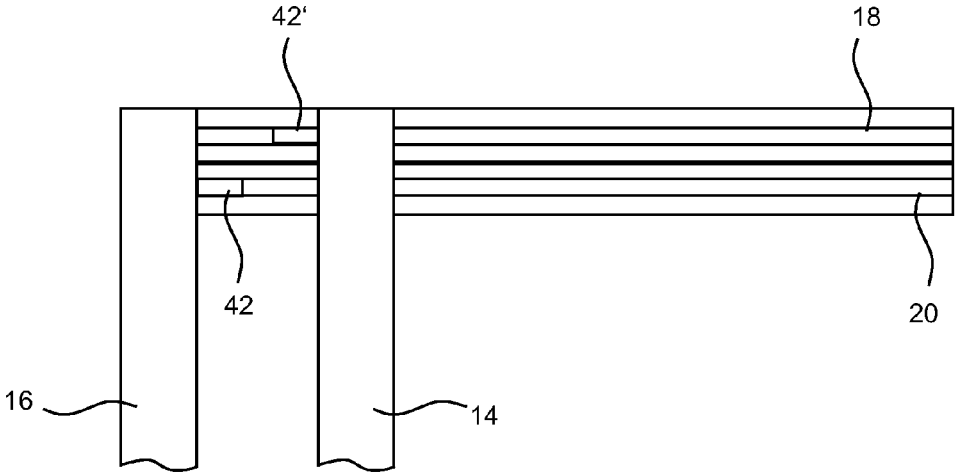
FIG. 8 is a schematic front view of an area of the device in order to illustrate the guidance of the load pick-up elements in two rails.

As can be seen in FIG. 8, by providing the first and second rails 18, in order to improve the mechanical stability or to increase the load-bearing capacity of the device 10, it is possible to design a suspension mount 42, 42' for the load pick-up elements 14, 16 situated in the rails 14, 16 in such a way that it is wider than the load pick-up elements 14, 16 themselves. This may be useful in order to carry the loads in the rail. When the right-hand load pick-up element 14 in the depiction of FIG. 8 is moved further to the left, the overhanging suspension mounts 42, 42' can be pushed behind each adjacent load pick-up element 14, 16. In contrast, if both load pick-up elements 14, 16 were to be configured in a shared upper rail, the overhanging suspension mounts 42, 42' would strike against each other in the rail and the two load pick-up elements could not be moved as close to each other as is possible.

The embodiment shown in the drawings is a combination of chains serving as force-transmissions with sprockets serving as the deflectors. It is noted that embodiments of the subject innovation are not restricted to the use of this embodiment, but rather, encompass all other conceivable force-transmissions such as, for example, belts or cables, as well as all other conceivable deflectors such as, for instance, pulleys and rollers. Moreover, the subject innovation also comprises all possible combinations of force-transmissions and deflectors.

What is claimed is:

1. A device for picking up loads, wherein said device is or can be attached to another piece of equipment, having a frame, first and second load pick-up elements, wherein the first and second load pick-up elements are configured so as to move on the frame along a direction of motion in a straight line, first and second drive units that are installed on the frame and arranged above one another, wherein each of the first and second drive units has a drive element and is configured to selectively move said drive elements in the following manners:

independently of each other; and simultaneously in two opposite directions; or consecutively in two opposite directions; or simultaneously in a corresponding direction; or consecutively in the corresponding direction parallel to the direction of motion in a straight line; or only one drive element can be moved, while the other drive element stands still, wherein at least a first pair of deflection means is rigidly installed on the drive element of the first drive unit, and wherein at least a second pair of deflection means is rigidly installed on the drive element of the second drive unit, and wherein deflection elements of each pair of deflection means are at a distance from each other in the direction of motion, wherein, for each of the deflection elements of each pair of deflection means, there is a force-transmission means that has a first attachment section and a second attachment section, wherein each force-transmission means of the first pair of deflection means and of the second pair of deflection means is attached by means of the first attachment section to a prescribed area of the frame, wherein each force-transmission means of the first pair of deflection means is attached by means of the second attachment section to the first load pick-up element, wherein each force-transmission means of the second pair of deflection means is attached by means of the second attachment section to the second load pick-up element, and wherein each deflection means of a pair of deflection means is engaged with an appertaining force-transmission means between the first attachment section and the second attachment section, and wherein a movement of the drive element of the first drive unit brought about by activating the first drive unit can be converted—via the deflection means of the first pair of deflection means and via the force-transmission means provided for the first pair of deflection means—into a corresponding movement of the first load pick-up element, and wherein a movement of the drive element of the second drive unit brought about by activating the second drive unit can be converted—via the deflection means of the second pair of deflection means and via the force-transmission means provided for the second pair of deflection means—into a corresponding movement of the second load pick-up element.

2. The device according to claim 1, wherein the drive units are formed by a piston drive with a cylinder housing and two piston rods that are attached to the frame, wherein the cylinder housing forms the drive element, and in that the piston rods are connected inside the cylinder housing to a piston that extends over the inner cross section of the cylinder housing, thus separating two areas inside the cylinder housing from each other, and in that, due to a feed of hydraulic medium into these two areas and due to a discharge of hydraulic medium out of these two areas inside the cylinder housing, the cylinder housing can then be moved along the piston rods in two opposite directions.

3. The device according to claim 2, wherein the deflection means are installed directly on an associated cylinder housing.

4. The device according to claim 3, wherein the drive units can be hydraulically connected to each other via a hydraulic control unit, wherein the areas inside the first cylinder housing that are separate from each other can be connected to the areas inside the second cylinder housing that are separate from each other in such a way that a volume of hydraulic medium that is discharged from an area inside the first cylinder housing can, at the same time, be fed into an area inside the second cylinder housing.

5. The device according to claim 4, wherein each piston rod has an interior channel whose one end is in communication with a feed site and with a discharge site for hydraulic medium, and whose other end has an opening leading towards one of the separate areas inside the cylinder housing.

6. The device according to claim 5, wherein the device has two first pairs of deflection means and two second pairs of deflection means, each provided with force-transmission means, wherein the deflection means of one pair of the two first pairs are arranged above the deflection means of the other pair of the two first pairs in such a way that, in each case, an axis of symmetry of a deflection means of the one pair is flush with an axis of symmetry of a deflection means of the other pair, and wherein the deflection means of one pair of the two second pairs are arranged above the deflection means of the other pair of the two second pairs in such a way that, in each case, an axis of symmetry of a deflection means of the one pair is flush with an axis of symmetry of a deflection means of the other pair.

7. The device according to claim 6, wherein the first load pick-up element is configured so as to move in a first rail installed on the frame, and in that the second load pick-up element is configured so as to move in a second rail installed on the frame, wherein the longitudinal axis of the first rail and the longitudinal axis of the second rail run parallel to each other.

8. The device according to claim 7, wherein the first load pick-up element and the second load pick-up element are additionally configured so as to move in a third shared rail.

9. The device according to claim 8, wherein the first and second rails are arranged above the drive units, while the third rail is arranged below the drive units.

10. The device according to claim 9, wherein at least one force-transmission means tensioner is provided on the first attachment section or on the second attachment section of each force-transmission means.

11. The device according to claim 10, wherein the at least one force-transmission means tensioners are lined up with an associated force-transmission means.

12. The device according to claim 11, wherein each force-transmission means is attached via an attachment means to a prescribed area of the frame, and to a load pick-up element, wherein at least one attachment means is configured as a force-transmission means tensioner, and wherein the attachment means and the at least one attachment means of each force-transmission means are arranged vertically offset with respect to each other, so that the force-transmission means can overlap.

13. The device according to claim 12, wherein the piece of equipment to which the device for picking up loads is or can be attached is a forklift.

14. The device according to claim 13, wherein the force-transmission means is a chain.

15. The device according to claim 14, wherein the deflection means are sprockets.

* * * * *